US007000965B2

(12) United States Patent
Lorincz

(10) Patent No.: US 7,000,965 B2
(45) Date of Patent: Feb. 21, 2006

(54) TANK LIFTING APPARATUS

(75) Inventor: Thomas A. Lorincz, Hollister, CA (US)

(73) Assignee: Therma Corporation, Inc., San Jose, CA (US)

( * ) Notice: Subject to any disclaimer, the term of this patent is extended or adjusted under 35 U.S.C. 154(b) by 218 days.

(21) Appl. No.: 10/412,730

(22) Filed: Apr. 11, 2003

(65) Prior Publication Data

US 2004/0201235 A1 Oct. 14, 2004

(51) Int. Cl.
*B66C 1/62* (2006.01)

(52) U.S. Cl. ..... 294/67.33; 294/90; 294/103.1

(58) Field of Classification Search ..... 294/81.1, 294/81.2, 81.21, 81.54, 81.62, 68.1, 68.3, 294/67.33, 90, 103.1, 119.1, 82.13, 34
See application file for complete search history.

(56) References Cited

U.S. PATENT DOCUMENTS 270,158 A * 1/1883 Van Patten ..... 294/106
2,327,005 A * 8/1943 Babcock et al. ..... 294/106
2,789,858 A * 4/1957 Kughler ..... 294/67.33
2,959,445 A * 11/1960 Breslav ..... 294/119.1
3,287,057 A * 11/1966 Gallapoo ..... 294/81.62
3,352,591 A * 11/1967 Casey ..... 294/106
5,171,053 A * 12/1992 Rouleau ..... 294/106
5,441,322 A * 8/1995 Jobmann et al. ..... 294/90
6,609,742 B1 * 8/2003 Macom et al. ..... 294/82.13

* cited by examiner

*Primary Examiner*—Dean J. Kramer
(74) *Attorney, Agent, or Firm*—Henneman & Saunders; Larry E. Henneman, Jr.

(57) ABSTRACT

A tank lifting attachment (10) is disclosed for allowing a tank, such as a wine press tank (12) to be lifted by a conventional lifting device (100) such as a crane or block and tackle. A center section (16) has a pair of inside grip plates (26) to abut the inner walls of the wine press tank (12). A first outside grip plate (28) and a second outside grip plate (42) are slidably affixed to the center section (16) such that the weight of the wine press tank (12) will cause a pair of under lip projections (38) affixed thereto to be secured under a portion of a lip (14) on the wine press tank (12). In an embodiment of the invention the tank lifting attachment (10) is secured to the lifting device (100) by a plurality of lifting straps (94).

20 Claims, 4 Drawing Sheets

TANK LIFTING APPARATUS

TECHNICAL FIELD

The present invention relates to the field of mechanical attachment apparatus, and more particularly for an apparatus used for attachment to tanks and other such containers which lack intrinsic handles or other lifting points. The predominant current usage of the present inventive tank lifting apparatus is for attachment to and lifting thereby of wine press tanks, which are large and heavy vessels that must be lifted into position, but which lack a convenient lifting handle or lift attachment means.

BACKGROUND ART

Wine press tanks are large, heavy, containers, shaped much like very large cooking pots. They are much too large and heavy to be moved by hand, and there is no readily apparent way to attach a lifting apparatus to the tanks. The tanks can, and are, occasionally moved by fork lift or other such means. However, this is a less than ideal solution to the problem. An overhead crane, or the like, could be used to move the tanks, when necessary. However, there has been no convenient, safe, and easy way to attach an overhead lifting device to the tanks in the prior art.

Because the tanks are very heavy, safety is an important concern. Any lifting means which would not securely hold the tanks and prevent them from falling on people and equipment would be unacceptable. On the other hand, a desirable lifting means would be easy and quick to attach, such that time and expense in the industrial environment would be conserved.

It would be beneficial to have a method and/or means for attaching a lifting apparatus to wine press tanks which would be both safe and easy to use. However, to the inventor's knowledge, no such method or means has existed in the prior art.

DISCLOSURE OF INVENTION

Accordingly, it is an object of the present invention to provide an apparatus for attaching a lifting means to a large container.

It is still another object of the present invention to provide a means for lifting a wine press tank.

It is yet another object of the present invention to provide a means for securely affixing a tank to a lifting device.

It is still another object of the present invention to provide a method and means for securing a lifting mechanism to a wine press tank.

Briefly, a known embodiment of the present invention is a lifting bracket apparatus for attaching to a lip of a wine press tank. The bracket has a center section and two sliding end sections. A pair of inner stops abuts the inner walls of the tank, and a pair of outer lip catches, affixed to the sliding sections, catch under a lip of the tank to securely affix the lifting bracket apparatus to the tank. A hoist harness is affixed to the sliding sections, such that when the lifting bracket apparatus is lifted by the hoist harness, inward pressure is applied to the sliding sections to secure the lip catches firmly under the lips of the tank.

These and other objects and advantages of the present invention will become clear to those skilled in the art in view of the description of modes of carrying out the invention, and the industrial applicability thereof, as described herein and as illustrated in the several figures of the drawing. The objects and advantages listed are not an exhaustive list of all possible advantages of the invention. Moreover, it will be possible to practice the invention even where one or more of the intended objects and/or advantages might be absent or not required in the application.

Further, those skilled in the art will recognize that various embodiments of the present invention may achieve one or more, but not necessarily all, of the above described objects and advantages. Accordingly, the listed advantages are not essential elements of the present invention, and should not be construed as limitations.

DETAILED DESCRIPTION

Figure 1:
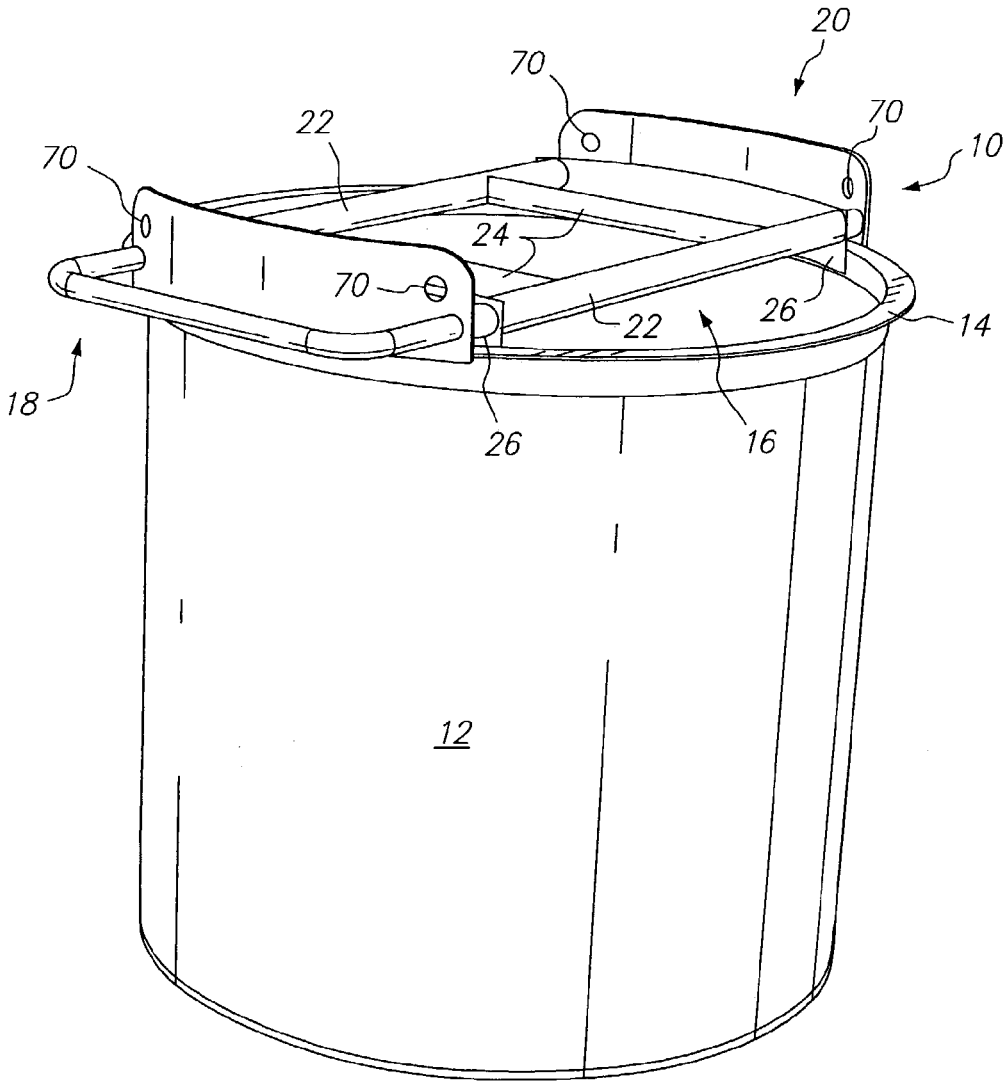
FIG. 1 is a perspective view of a wine press tank with a lifting attachment apparatus affixed thereto, according to one embodiment of the present invention.

The embodiments and variations of the invention described herein, and/or shown in the drawings, are presented by way of example only, and are not limiting as to the scope of the invention. Unless otherwise specifically stated, individual aspects and components of the invention may be omitted or modified, or may have substituted therefore known equivalents, or as yet unknown substitutes such as may be developed in the future or such as may be found to be acceptable substitutes in the future. The invention may also be modified for a variety of applications while remaining within the spirit and scope of the claimed invention, since the range of potential applications is great, and since it is intended that the present invention be adaptable to many such variations.

A known mode for carrying out the invention is a tank lifting attachment apparatus. The inventive tank lifting attachment apparatus is depicted in a perspective view in FIG. 1, and is designated therein by the general reference character 10. The tank lifting attachment apparatus 10 is shown affixed to a wine press tank 12. The wine press tank 12 has a lip 14 around the upper rim thereof, whereby the talk lifting attachment apparatus 10 can be affixed.

The tank lifting attachment 10 has a center section 16, a first end section 18 and a second end section 20. In the embodiment of the invention described, the center section 16 has two stretcher tubes 22, two cross braces 24, and two inside grip plates 26, all of which are rigidly affixed together, by welding in this example. The first end section 18 and the second end section 20 are movably affixed in relation to the center section 16, as will be described in more detail hereinafter.

Figure 2:
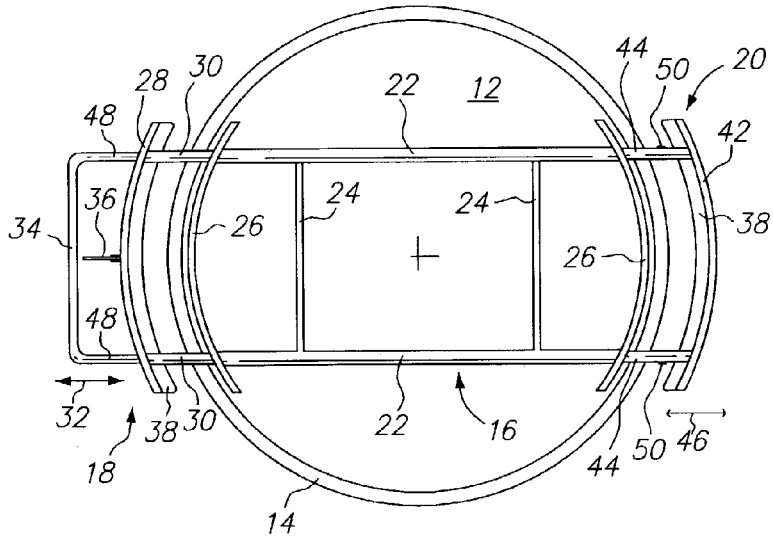
FIG. 2 is a top plan view of the lifting attachment apparatus, similar to that shown in the view of FIG. 1.

FIG. 2 is a top plan view of an example of the tank lifting attachment 10. As can be seen in the view of FIG. 2, the first end section 18 has an outside grip plate 28 for catching the lip 14 of the wine press tank 12. The first outside grip plate 28 is rigidly affixed to a pair of first end section slider tubes 30. The first end section slider tubes 30 are slidably inserted within the stretcher tubes 22 such that the first outside grip plate 28 is free to move inward and outward in relation to the wine press tank 12, as indicated by directional arrow 32. A latching rod 34 is provided for latching the tank lifting attachment 10 in an open position, as will be discussed in more detail hereinafter. A latching hook 36 is movably affixed to the first outside grip plate 28 for hooking over the latching rod 34. As can be seen in the view of FIG. 2, the first outside grip plate 28 has an under lip projection 38 for catching under the lip 14 of the wine press tank 12.

The second end section 20 has a second outside grip plate 42 which is rigidly affixed to a pair of second end section slider tubes 44. The second end section slider tubes 44 are slidably inserted within the stretcher tubes 22 such that the second outside grip plate 42 is free to move inward and outward in relation to the wine press tank 12, as indicated by directional arrow 46. A pair of longitudinal sections 48 of the latching rod 34 extend through the stretcher tubes 22, within the first end section slider tubes 30 and the second end section slider tubes 44, and are rigidly affixed to the second end section slider tubes 44 by a pair of set screws 50. Therefore, it can be seen that the latching rod 34 is free to side within the first end section slider tubes 30, such that the first end section 18 is free to move as indicated by directional arrow 32 while the latching rod 34 remains stationary, unless the latching hook 36 is hooked over the latching rod. However, in normal operation, when the set screws 50 are tightened against the longitudinal sections 48 of the latching rod 34 (as they will be when the tank lifting attachment 10 is fully assembled and ready for operation), then the second end section 20 is rigidly affixed to the latching rod 34 such that the latching rod 34 and the second end section 20 can only move together as either moves in relation to directional arrow 46. The second outside grip plate 42 also has an under lip projection 38 for catching under the lip 14 of the wine press tank 12.

Figure 3:
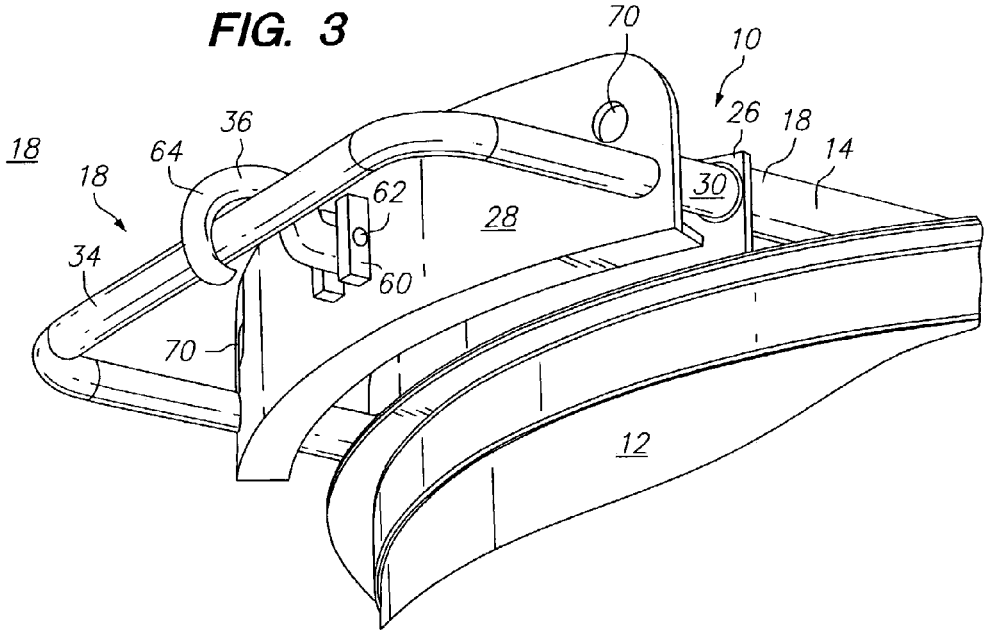
FIG. 3 is perspective view of a portion of the lifting attachment of FIGS. 1 and 2.

FIG. 3 is a perspective view of a portion of an example of the tank lifting attachment 10, showing the first end section 18. As can be seen in the view of FIG. 3, the latching hook 36 is movably affixed to the first outside grip plate 28 by a pin attachment plate 60 and pin 62 such that a hook portion 64 of the latching hook 36 can be hooked over the latching rod 34 by slightly rotating the latching hook 36 about the pin 62 in relation to the pin attachment plate. The latching hook 36 is held in place over the latching rod 34 by gravity until it is manually removed therefrom.

Also visible in the view of FIG. 3 are two of four lifting device attachment apertures 70 (all four of which are visible in the view of FIG. 1), which will be discussed in more detail hereinafter.

Figure 4:
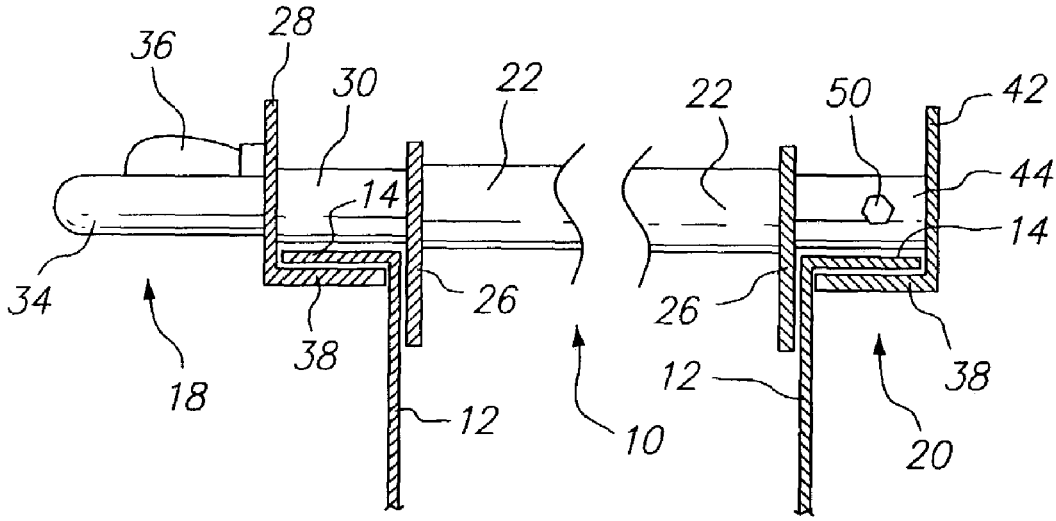
FIG. 4 is a cross sectional elevational view of an example of the inventive lifting attachment.
Figure 5:
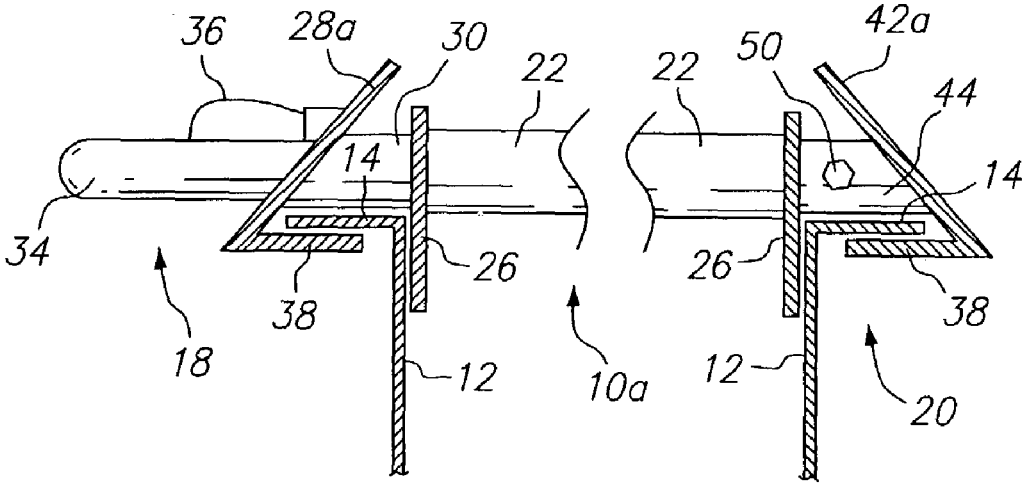
FIG. 5 is a cross sectional elevational view of a portion of another embodiment of the inventive lifting attachment.

FIG. 4 is a cross sectional elevational view of an embodiment of the tank lifting attachment 10. As can be seen in the view of FIG. 4, when the first outside grip plate 28 and the second outside grip plate 42 are pulled against the wine press tank 12, the under lip projections 38 can be used to lift the wine press tank 12. FIG. 5 is a cross sectional elevational view of another embodiment of the tank lifting attachment 10*a*, showing an alternate first outside grip plate 28*a* and an alternate second outside grip plate 42*a*. As can be seen in the view of FIG. 5, both the first alternate grip plate 28*a* and the second alternate grip late 42*a* are angled inward somewhat, as compared to the first outside grip plate 28 and the second alternate grip plate 42 depicted in the example of FIG. 4.

Figure 6:
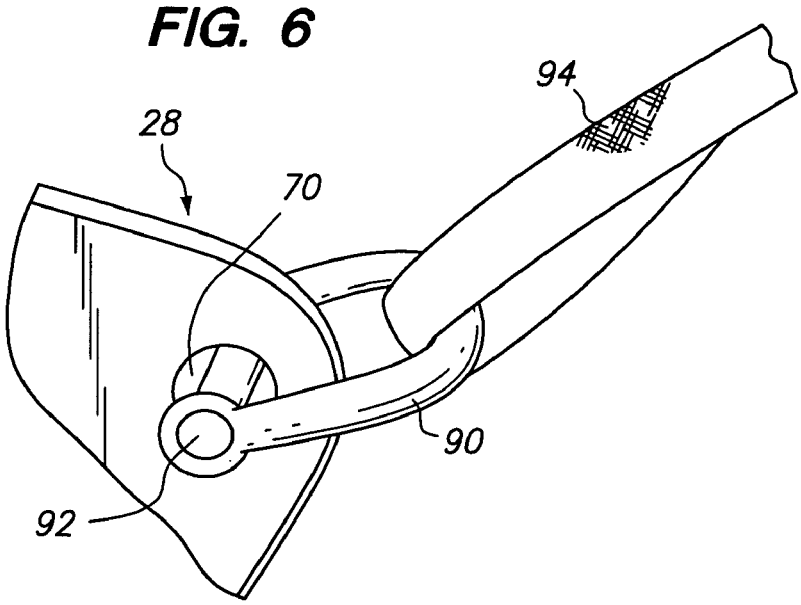
FIG. 6 is a perspective view of an example of the inventive lifting attachment with a lifting apparatus affixed thereto.

FIG. 6 is a perspective view of an example of the first outside grip plate 28 showing a clevis 90 and clevis pin 92 affixed to the attachment aperture 70 such that a lifting strap 94 is securely affixed to the outside grip plate 28 by the clevis 90 and clevis pin 92. In practice, an iteration of the clevis 90, clevis pin 92 and lifting strap 94 can be affixed to each of the attachment apertures 70 (FIG. 1). The lifting straps 94 can then be secured to a conventional lifting device, such as a block and tackle, crane, or the like.

Figure 7:
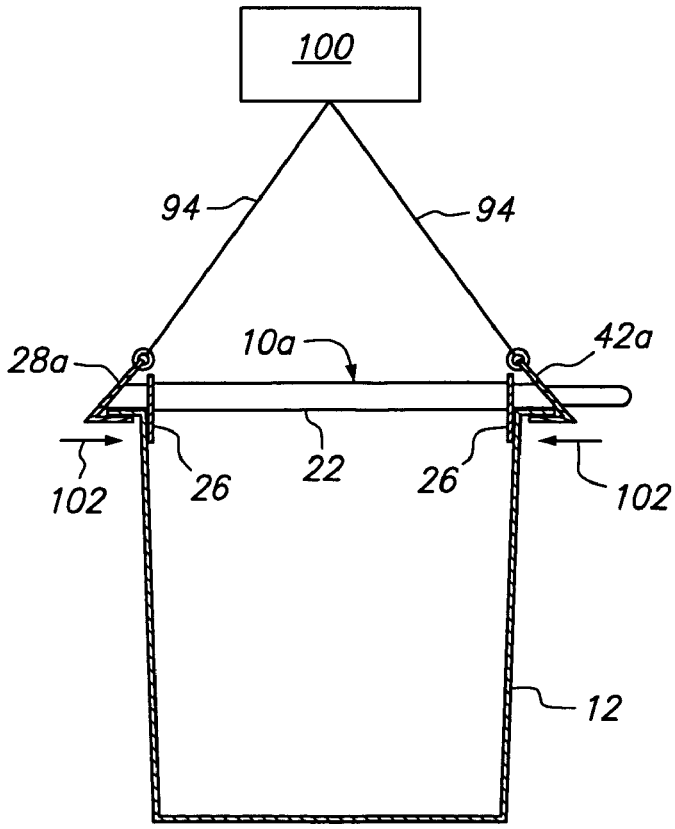
FIG. 7 is a cross sectional side elevational view of a wine press tank being lifted according to the present inventive method.

FIG. 7 is a cross sectional elevational view of a wine press tank 12 being lifted using the tank lifting attachment 10*a* with four lifting straps 94 (two of which are visible in the view of FIG. 7). A generic lifting device (a crane, a lift truck, or the like, as discussed above) is depicted in block form and indicated by the numeric reference 100. As can be appreciated in light of the example of FIG. 7, the weight of the wine press tank 12 will cause the first outside grip plate 28*a* and the second outside grip plate 42*a* to be pulled inward, toward the wine press tank 12, as indicated by the inward directional arrows 102. Thus, the weight of the wine press tank 12 will prevent the tank lifting attachment 10*a* from becoming detached from the wine press tank 12 while the wine press tank 12 is suspended from the lifting device 100 by the lifting straps 94.

Indeed, the greater the weight of tank 12, the greater will be the inward force applied by first outside grip plate 28*a* and second outside grip plate 42*a*. Inside grip plates 26 are shaped similar to the wall of tank 12 (arcuate in this example), and are supported by stretcher tubes 22, to support the wall of tank 12 against the inward force applied by outside grip plates 28*a*, 42*a*. Thus, deformation of tank 12 is prevented.

Various modifications may be made to the invention without altering its value or scope. For example, one skilled in the art will recognize that many alternative means for attaching the tank lifting attachment 10 to the lifting device 100 might be employed. For example, a chain could be used instead of the lifting straps 94 and/or hooks could be used instead of the clevis 90 and clevis pin 92. Also, one skilled in the art will recognize that placement, position, and shape of many of the components of the embodiments described herein could readily be modified, eliminated and/or augmented without significantly deviating from the described functionality of the invention.

All of the above are only some of the examples of available embodiments of the present invention. Those skilled in the art will readily observe that numerous other modifications and alterations may be made without departing from the spirit and scope of the invention. Accordingly, the disclosure herein is not intended as limiting and the appended claims are to be interpreted as encompassing the entire scope of the invention.

INDUSTRIAL APPLICABILITY

The inventive tank lifting attachment 10, 10*a* is intended to be widely used in the lifting of tank type containers such as the described wine press tank 12. While the invention is now intended primarily for use with the wine press tanks 12, the invention could readily be adapted for use with other types of containers or other such devices.

Since the tank lifting attachment 10, 10*a* of the present invention may be readily produced and integrated with existing wine press tanks 12, lifting devices 100, and the like, and since the advantages as described herein are provided, it is expected that it will be readily accepted in the industry. For these and other reasons, it is expected that the utility and industrial applicability of the invention will be both significant in scope and long-lasting in duration.

I claim:

1. A tank lifting apparatus, comprising:

a center section including at least one tubular member and at least one outwardly facing surface fixed to the center section and disposed to abut an interior surface of a tank;

a first end section slidably disposed within a first end of the tubular member; and a second end section slidably disposed within a second end of the tubular member; wherein said first end section and said second end section secure the tank therebetween.

2. The tank lifting apparatus of claim 1, wherein:

the at least one outwardly facing surface is disposed an an inner plate for abutting the interior of the tank.

3. The tank lifting apparatus of claim 1, wherein:

at least one of said first end section and said second end section have an under lip projection adapted for placement under an upper lip of the tank.

4. The tank lifting apparatus of claim 3, wherein:

the under lip projection is affixed to an outer plate that selectively abuts the tank.

5. The tank lifting apparatus of claim 1, and further including:

a plurality of attachment apertures whereby the tank lifting apparatus can be attached to a lifting device.

6. The tank lifting apparatus of claim 5, wherein:

a plurality of flexible members are used to connect the tank lifting apparatus to the lifting device.

7. The tank lifting apparatus of claim 6, wherein: the flexible members are straps.

8. The tank lifting apparatus of claim 5, wherein:

when the tank lifting apparatus is lifted from the attachment apertures, said first end section and said second end section are pulled toward said center section.

9. The tank lifting apparatus of claim 5, wherein:

when the tank lifting apparatus is lifted from the attachment apertures, the tank is secured between said first end section and said second end section.

10. The tank lifting apparatus of claim 1, wherein:

the first end section includes a tubular support member slidably disposed within the first end of the tubular member of the center section; and the second end section is coupled to a latching member passing through the tubular support member of the first end section.

11. The tank lifting apparatus of claim 10, further including a securing device for selectively securing the latching member to the first end section, thereby retaining the tank lifting apparatus in an open position.

12. A tank lifting apparatus comprising:

a center section for positioning generally inside the horizontal limits of a tank, the center section including a first support plate adapted to abut a first portion of an inner wall of the tank, a second support plate adapted to abut a second portion of the inner wall of the tank, and a frame including at least one tubular member, the frame fixed to the first support plate and the second support plate to maintain the first support plate and the second support plate a spaced distance from one another;

a first end section including a support member slidably disposed in a first end of the tubular member of the center section for engaging an upper edge of the tank between the first end section and the center section when the first end section is moved toward the center section; and a second end section including a support member slidably disposed in a second end of the tubular member of the center section for engaging the upper edge of the tank between the second end section and the center section when the second end section is moved toward the center section.

13. The tank lifting apparatus of claim 12, wherein:

the first end section includes an inward projection for positioning under a portion of the tank; and the second end section includes an inward projection for positioning under a portion of the tank.

14. The tank lifting apparatus of claim 12 wherein:

said frame includes two tubular members;

said first end section includes two support members, each slidably disposed in a first end of a respective one of said tubular members; and said second end section includes two support members, each slidably disposed in a second end of a respective one of said tubular members.

15. The tank lifting apparatus of claim 14, wherein:

at least one of said support members of said first end section is tubular; and at least one of said support members of said second end section is coupled to a latching member passing through said tubular support member of said first end section.

16. The tank lifting apparatus of claim 15, further including a securing device for selectively securing said latching member to said first end section, thereby retaining said tank lifting apparatus in an open position.

17. The tank lifting apparatus of claim 12, wherein:

said first end section includes a support plate having the same general shape as said first support plate of said center section; and said second end section includes a support plate having the same general shape as said second support plate of said center section.

18. The tank lifting apparatus of claim 17, wherein said support plates are curved to conform to a round tank.

19. The tank lifting apparatus of claim 17, wherein:

the support plate of said first end section includes a ledge adapted to support a projection of said tank; and the support plate of said second end section includes a ledge adapted to support a projection of said tank.

20. The tank lifting apparatus of claim 12, further comprising a harness coupled to said first end section and said second end section, whereby an upward force applied to said harness draws said first end section and said second end section toward said center section.

* * * * *